United States Patent [19]

Manini

[11] 3,950,965

[45] Apr. 20, 1976

[54] AUXILIARY LINKAGE FOR AMPLIFYING NEEDLE MOVEMENT IN CIRCULAR KNITTING MACHINES

[75] Inventor: Benito Manini, Florence, Italy

[73] Assignee: Billi S.p.A., Florence, Italy

[22] Filed: Apr. 29, 1974

[21] Appl. No.: 465,129

[30] Foreign Application Priority Data

Apr. 27, 1973 Italy ..... 9436/73

[52] U.S. Cl. ..... 66/50 R; 66/42

[51] Int. Cl.[2] ..... D04B 9/00

[58] Field of Search ..... 66/8, 50 R, 50 A, 50 B, 66/42, 115, 25, 75 R

[56] References Cited

UNITED STATES PATENTS

| | | | |
|---|---|---|---|
| 2,721,460 | 10/1955 | Lombardi | 66/50 R |
| 3,646,779 | 3/1972 | Nuber et al. | 66/25 |
| 3,793,850 | 2/1974 | Wills-Moren et al. | 66/50 R |

FOREIGN PATENTS OR APPLICATIONS

| | | | |
|---|---|---|---|
| 585,557 | 3/1925 | France | 66/50 A |
| 478,814 | 7/1929 | Germany | 66/50 B |
| 1,140,839 | 1/1969 | United Kingdom | 66/8 |

OTHER PUBLICATIONS

Knitting Times, Vol. 42 No. 7, Feb. 12, 1973, pp. 94 & 95.

*Primary Examiner*—Mervin Stein
*Assistant Examiner*—A. M. Falik
*Attorney, Agent, or Firm*—Haseltine, Lake & Waters

[57] ABSTRACT

The invention relates to a control system for the lifting or raising of needles within their respective grooves or channels about the circumference of a conventional multi-feed circular knitting machine, with the aid of jacks and operational cams for said jacks, wherein the movement of the needles is amplified with respect to the movement of their associated jacks.

3 Claims, 7 Drawing Figures

II
9
7
23
23A
5
11
y
17
z
19A
15
13A
23B
19
19C
21
19B
III
47
49
43
1
33
35
39
43A
13
IV
37
IV
51
13C
53
32B
32A
33
33E
61
13B
33F
41
63
45
II
31
65
69
III
3

AUXILIARY LINKAGE FOR AMPLIFYING NEEDLE MOVEMENT IN CIRCULAR KNITTING MACHINES

BACKGROUND OF THE INVENTION

It is well known to those familar with the knitting industry that production is increased by the addition of more yarn feed stations on a circular machine. Hosiery machines generally have a needle cylinder of about 4 inches in diameter and it is known to put as many as 12 feed stations about the circumference of such a machine, but because of space limitations, sacrifices in operating effeciency have been heretofore required, with the result that 8 feed stations is about the maximum number of feeds for practical purposes, and many mills prefer fewer feeds for consistent operation.

Successive needles are raised at each feed station to take yarn for forming new stitches. It is conventional to employ jacks to raise the needles on multi-feed machines. The jacks are positioned immediately beneath the needles in vertical grooves around the circumference of the needle cylinder. The jacks are equipped with butts which engage lifting cams positioned in the path of the jack butts at each feed station. The cams cause the jacks to rise within their respective grooves and to abut directly against the knitting needles positioned above the jacks in corresponding grooves, causing upward movement of the needles directly proportional to the upward movement of the jacks caused by their engagement with the cams.

Summary of the Invention

According to the invention, linkages designed to transmit to the needles a multiplied movement with respect to the one imposed by the cams on the jacks, are interposed between the jacks and the needles.

The linkage interposed between jack and needle specifically includes at least one small lever designed to transmit a movement amplified by the ratio of the length of the arm between the pivot and the contact point to the length of the arm between the pivot and the jack action point.

In a preferred embodiment, the linkage interposed between jack and needle includes two opposed levers, cooperating with each other, a first lever being actuated by the jack and acting on the second lever, and the latter acting in turn on the needle. The first lever may be linked at its end nearest the cylinder axis to the needle cylinder and project radially outwardly for vertical movement while the second lever is linked to the annular structure surrounding the cylinder and extends inwardly toward the needle cylinder and its associated jack and needle.

Objects of the Invention

An object of the invention is to obtain a desirably high stroke of successive needles at each yarn feed with apparatus occupying less circumferential space about the needle cylinder than in conventional systems, thus providing more circumferential space and thereby making it possible to correspondingly increase the number of yarn feed stations in the same space.

Another object of the invention is the raising of needles to a desired height by means of auxiliary linkage which increases the amplitude of upward needle movement with respect to movement of the jack, which allows for more space circumferentially and a corresponding increase in the number of feeds, besides other advantages.

These and other objects will become apparent to those skilled in the art by reading the following description.

BRIEF DESCRIPTION OF THE DRAWINGS

The invention will be better understood from the following description taken in connection with the accompanying drawings in which.

DETAILED DESCRIPTION OF THE INVENTION

Figure 1:
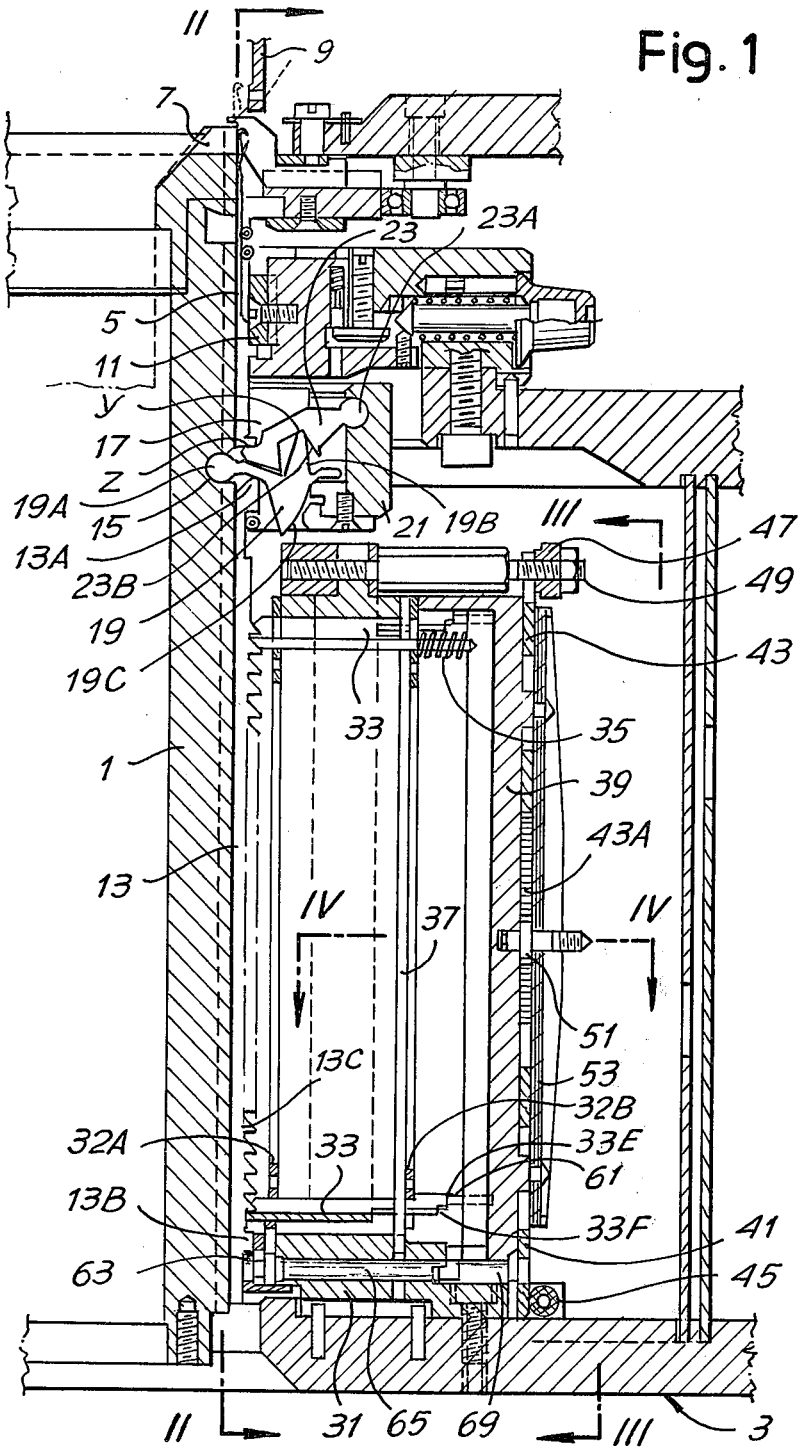
FIG. 1 is a vertical sectional view of one feed of a multi-feed circular knitting machine, partially in elevation and showing one needle and its associated lifting mechanism in accordance with the invention.

Referring now to the drawings, there is shown, in pertinent part, a conventional multi-feed circular knitting machine of the type particularly adapted for the knitting of ladies stockings and panty hose and which comprises a needle cylinder 1 and an annular stationary frame 3. The needle cylinder rotates relative to the frame in the illustrated embodiment, but the invention is equally applicable with that class of machine wherein the frame rotates relative to the cylinder.

The needle cylinder has a plurality of vertically extending grooves within each of which is mounted a knitting needle, only one of which is indicated at 5. The machine also includes a like number of sinkers 7 which cooperate with the needle to form the knit stitches. A yarn guide 9 feeds the yarn to the needles at each of the feed stations, only one being indicated in the drawings. Each feed station includes a stitch cam which draws successive needles downwardly to their knockover or maximum draw position.

The needles are raised at each feed station to any desired height, such as the inactive position or the clearing position, or to any other position above the knockover position by jacks assembled in the needle grooves of the cylinder 1 and responsive to actuation by conventional camming to directly contact its associated needle spaced immediately above the jack in their respective needle grooves to raise it to a predetermined height.

According to the invention, auxiliary linkage is provided between the upper end of each jack and the lower end of its associated needle. The linkage comprises first and second levers (19 and 23) for each needle groove, the first levers 19 each being journaled in the needle cylinder and extending radially outwardly therefrom. The second levers 23 are journaled in an annular rim 21 and extend toward the needle cylinder for engagement with their respective first levers 19. More specifically, each of the first levers 19 are journaled in a circular recess 15 communicating with respective needle grooves at a position between the lower ends of their respective needles and the upper ends of their associated jacks. The circular recesses or seats 15 communicate with their corresponding needle grooves, and the walls of the grooves each have extensions or flanks 17 extending radially therefrom. Each lever 19 is positioned between a pair of flanks 17, and has a circular extension 19A of corresponding configuration with the circular recesses 15. With the extension 19A seated within the recess 15, the lever 19 extends radially between the extensions or projecting flanks 17.

An annular rim 21 is engaged to the outer ends of the flanks 17 which extend radially from the needle cylinder 1 and the rim 21 is movable with the needle cylinder. The rim 21 has a circular recess or seat for the reception of the circular extension 23A on each of a plurality of levers 23 corresponding in number to the levers 19 and co-acting with the same to raise the needles an amplified amount in relation to the movement of the jack. Each lever 19 is in contact with its lever 23 through respective cam surfaces 19B and 23B which retain the pairs of levers 19 and 23 in their respective seats. The rim 21 is provided with an annular projection 21X and an annular member 221 is clamped on rim 21 by screws 321. Flanks 17 have annular projections 117 which overlap and are clamped between projections 21X and 221 by the screws 321.

Each lever 19 is raised with the aid of the upper end 13A of the corresponding jack 13, which engages a point X a short distance radially upwardly from the seat 15 of the extension 19A. The upper end of the cam surface 19B contacts the lever 23 at the point Y which is located further from the seat 15 and the circular extension 19A than is the point X. The lever 23 contacts the lower end of its associated needle 5 at the point Z which is further from the extension 23A than is the point Y. It follows from the above that any elevation or lifting of a jack 13 causes a much higher elevation or lifting of its respective needle, owing to the amplification resulting from the interaction of the two levers 19 and 23 making contact at the points X, Y and Z in response to elevation of a jack. Consequently, it is possible to use a relatively low cam surface in the trajectory S1 of the jacks to cause the desired higher elevation of the trajectory S2 of the needles previously obtained by a direct contact of the needles by their respective jacks in the prior art. The use of a low profile in the trajectory S1 of the jack is beneficial in operating at higher speeds. The use of the auxiliary levers for lifting the needles is also advantageous in that it makes possible a circumferential reduction of the space required for the jack cams and yet results in the needles being elevated to the same height as in the conventional system. Of course, any decrease in the circumferential space requirements correspondingly increases the available space for yarn feed stations in a given circumference.

Spaced around the annular frame 3, and in correspondence of the row of removable control butts of the jacks 13, small blocks 31 are located in radially adjustable position, there being one such block for each yarn feed station, and more specifically in correspondence of each lifting trajectory S1 and S2. In each block 31, through suitable racks 32A and 32B, there are formed tangentially positioned radial seats for the reception of a plurality of pattern blades 33, arranged to act on the jack butts. Each blade 33 has on its inner end a first cammed surface 33A and a second cammed surface 33B, the first cammed surface 33A being at a lower elevation than the second cammed surface 33B. The first cammed surface 33A acts on the jack butts when the blade 33 is advanced only partially in a centripetal direction to a first position, while the cammed surface 33B acts on the jack butts when the blade 33 is advanced centripetally to its fullest extent.

Each blade 33 includes a rear leg 33C having a head on its free end which retains a compression spring 35 encircling the rear leg 33C and engagable with the rear rack 32B to urge its respective blade 33 in the centrifugal direction to a suitable stop comprising a bar 37 bearing against the rear rack 32B. Bar 37 prevents the blades 33 moving to the right in FIG. 1 beyond the contact position of wall 33X with the same bar 37. Each blade 33 also includes at its rear a stepped profile comprising two step portions 33E and 33F. The step portion 33E defines the rear edge of a laterally extending projection which has a forward edge or stop 33G.

A stand member 39 is removably supported on a rear surface of each block 31, and the stand members 39 may be quickly connected in place by vertically extending racks 41 and 43. The rack 41 has a lower end releasably confined by a roller stop 45 while the upper rack 43 is bifurcated at its upper end and is releasably retained by a washer 47 retained on a threaded stud 49 by a suitable locknut in an adjustable manner. A sprocket wheel 51 is journaled for engagement with the teeth of the racks 41,43 to control their movement in opposite directions intermediate the roller wheel 45 and the threaded stud 49 and each of the racks 41 and 43 extend sufficiently beyond the sprocket wheel to be operatively engaged thereby. The two racks 41,43 are guided in their vertical movement within the stand 39. A cover 53 retains the racks 41,43 and the sprocket wheel 51 in the stand 39.

Figure 2:
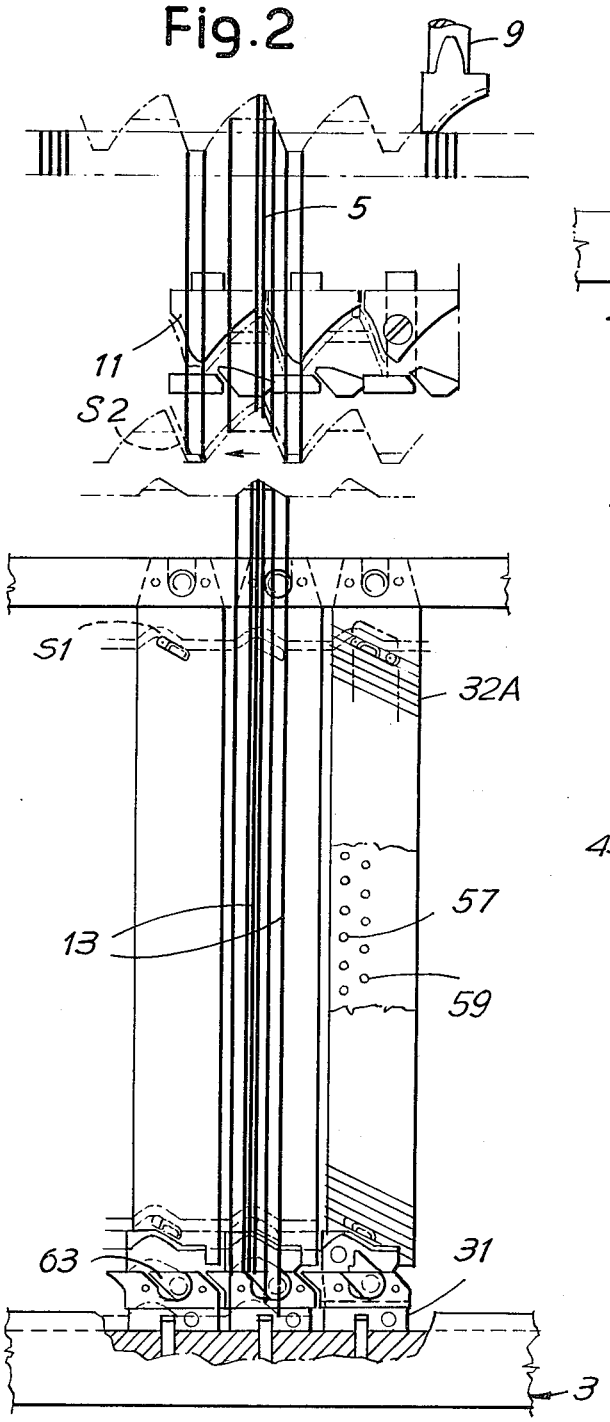
FIG. 2 is a vertical sectional view, mostly in elevation taken substantially along the line II—II in FIG. 1 which coincides with the needle groove illustrated in FIG. 1.
Figure 3:
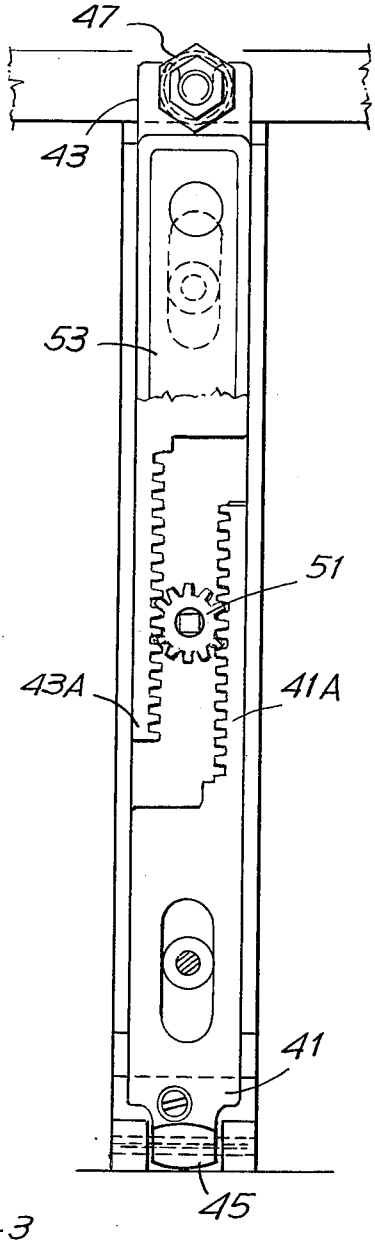
FIG. 3 is a vertical sectional view taken substantially along the line III—III in FIG. 1 and mostly in elevation.
Figure 4:
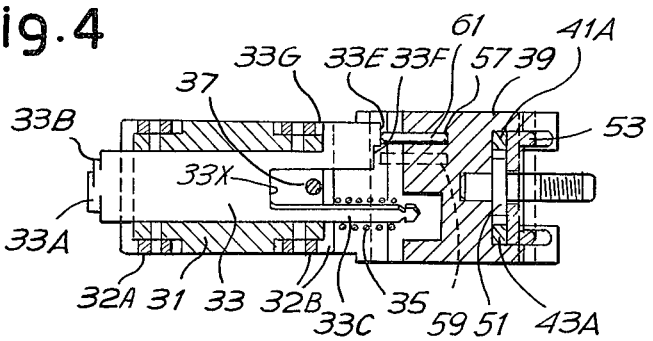
FIG. 4 is an enlarged sectional plan view taken substantially along the line IV—IV in FIG. 1.
Figure 5:
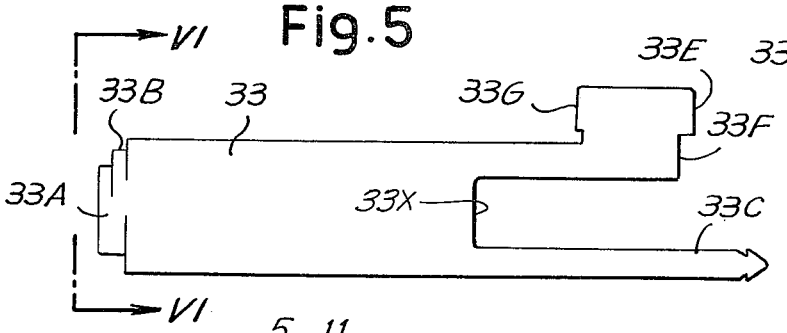
FIG. 5 is an enlarged elevation of a pattern blade removed from the machine.
Figure 6:
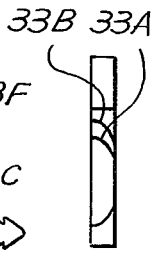
FIG. 6 is an end view of the pattern blade looking in the direction of the arrows VI—VI in FIG. 5.
Figure 7:
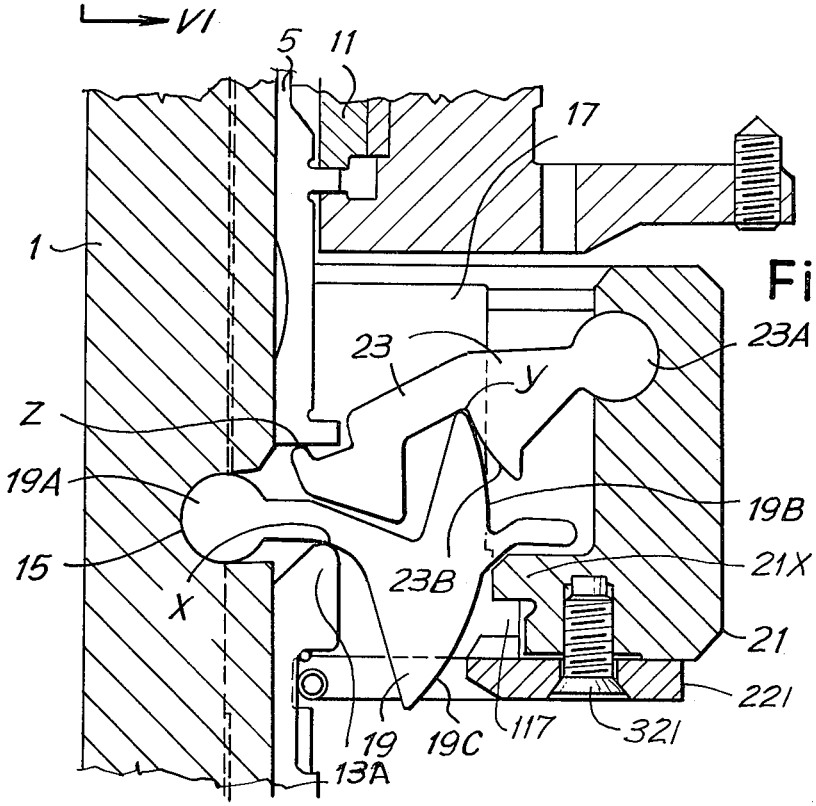
FIG. 7 is an enlarged detail view of the medial portion of FIG. 1 showing the associated lifting mechanism between the jack and needle.

Each stand 39 contains a plurality of vertically arranged holes on the inner surface, said holes being arranged in two staggered rows, indicated respectively at 57 and 59 in FIGS. 2 and 4 and located in correspondence of the steps 33E and 33F on the respective blades 33. The holes 57 and 59 provide seats for pins 61 which may be removably retained within their seats formed by the holes in the rows 57 and 59. The pins 61 are of equal length and are arranged in selected seats before applying a stand 39 to its block 31 to obtain predetermined positionings of the blades 33. For example, a pin 61 in a hole of the row 57 acts (after assembly of the stand) on the corresponding blade 33 by contacting the surface 33E and thus urging the blade 33 centripetally until the cammed surface 33B lifts the jacks to a relatively high position (FIG. 4). By way of further example, a pin 61 in a hole of the row 59 acts, upon assembly of the stand 39, on the corresponding blade by contacting the surface 33F and thus urging the blade 33 centripetally until only the stepped portion 33A contacts the jacks to raise them a relatively lesser height. The absence of a pin 61 in the corresponding blade 33 not being advanced and thus remaining excluded.

Assuming the desired number of pins 61 to be positioned as desired within the holes in rows 57 and 59 in a stand 39, and assuming the stand 39 to have been attached to its respective block 31, the pins 61 will instantly contact one of the stepped portions 33E or 33F. However, centripetal movement of the blades 33 contacted by the pins 61 may be prevented because the jacks are in a non-raised position or are not raised to a position coinciding to the selection conditions required by the particular arrangement of the pins 61 in the stand 39 which is assumed to have been attached to its respective block 31.

In order to preposition the jacks to be receptive to the desired placement of the pins 61, a cam 63 is mounted on a manually rotatably shaft 65, the cam 63 being adjustable by rotation of shaft 65 to act on a lower butt 13B of the jacks 13 causing all of the jacks 13 to climb in correspondence of the centripetally projecting blades 33 through engagement with their respective cammed surfaces 33A or 33B. This prevents interference of the blades 33 with the butts 13C. Whereupon the shaft 65 is manually rotated through a passage 69 formed between the block 31 and the stand 39 to inactivate the cam 63 and permit needle selection by the blades 33. With the foregoing apparatus, it is easy to make a desired needle selection and it is easy to modify the needle selection according to the working requirements. It is possible, also, to arrange a set of stands 39 with the pins 61 located in the desired manner to provide the desired needle selection before removing from the knitting machine stands having pin placements for a different pattern of needle selection. Thus, the present invention provides an effective and efficient means of needle selection which may be readily changed with a minimum of down time.

A preferred embodiment of the invention has been described, but without limitation; the scope of the invention being defined by the claims.

What is claimed is:

1. In a circular knitting machine having a needle cylinder, at least one feed station and a plurality of vertically extending grooves circumferentially arranged about said needle cylinder for the reception of vertically movable knitting needles and vertically movable jacks positioned beneath at least some of said needles and means for imparting a given amount of upward movement to certain of said jacks at said feed station, the combination of an auxiliary linkage between the upper ends of the jacks and the lower ends of corresponding needles, said auxiliary linkage comprising two pivoted levers having separate pivot points, said levers extending across the vertical path of travel of a respective jack and cooperating with each other and with said jack and corresponding needle in a given groove, a first of said levers being positioned for engagement by the jack in its upward movement at a point spaced radially from said groove to impart movement to the second of said levers positioned for responsive engagement with the needle to impart thereto an amplified movement with respect to said given amount of upward movement of the jack.

2. A structure according to claim 1 wherein said first lever is pivotally connected to the needle cylinder and extends toward the axis of the cylinder and wherein an annular rim is supported radially inwardly of the needle cylinder and movable therewith, and said second lever is pivotally supported by the annular rim and extends radially toward the needle cylinder into engagement with the lower end of the needle.

3. A structure according to claim 2 wherein the jack engages the medial portion of the first lever and the free end of the first lever engages the medial portion of the second lever.

* * * * *